United States Patent [19]

Turley

[11] Patent Number: 4,745,556

[45] Date of Patent: May 17, 1988

[54] ROLLING MILL MANAGEMENT SYSTEM

[75] Inventor: John W. Turley, Oxford, Conn.

[73] Assignee: T. Sendzimir, Inc., Waterbury, Conn.

[21] Appl. No.: 880,801

[22] Filed: Jul. 1, 1986

[51] Int. Cl.[4] ..... G06F 15/46; B21B 37/00

[52] U.S. Cl. ..... 364/472; 72/11

[58] Field of Search ..... 364/472, 148; 72/8, 72/11, 16

[56] References Cited

U.S. PATENT DOCUMENTS

| | | | |
|---|---|---|---|
| 4,494,205 | 1/1985 | Dairiki et al. | 364/472 |
| 4,520,642 | 6/1985 | Niino et al. | 364/472 X |
| 4,521,859 | 6/1985 | Fapiano | 364/472 |
| 4,598,377 | 7/1986 | Takagi et al. | 364/472 |
| 4,633,693 | 1/1987 | Tahara et al. | 364/472 |

*Primary Examiner*—Joseph Ruggiero

*Attorney, Agent, or Firm*—Frost & Jacobs

[57] ABSTRACT

A new method of operating reversing rolling mills whereby rate of production is maximized and strip or sheet flatness is improved.

A digital computer which is provided with information describing the rolling mill equipment, the material to be rolled, and the starting dimensions and required finished dimensions of this material, is used to direct the adjustment of the mill settings before every pass, as limited by the load capacity of the mill and the power and speed of its drive, and to equalize the roll separating force on the last several passes in order to achieve the optimum product flatness.

The system is designed to allow for full operator intervention at any stage, and will redirect the adjustment of mill settings on all passes succeeding the pass(es) in which the operator intervened, to maximize production and optimize product flatness for the remaining passes.

8 Claims, 5 Drawing Sheets

FIGURE 1 - PRIOR ART

ROLLING MILL MANAGEMENT SYSTEM

TECHNICAL FIELD

The invention relates generally to rolling mills and more particularly to a control system for optimizing the operation for a rolling mill. The invention will be specifically disclosed in connection with a reversing rolling mill control system for calculating and adaptively modifying a multi-pass reduction schedule.

BACKGROUND OF THE INVENTION

Generally, an experienced operator of a reversing rolling mill will adjust his mill settings according to his prior experience with the same mill on a previous occasion. It will be readily appreciated, however, that such a method is almost totally dependent upon the skill of the operator and is replete with inefficiencies.

There are several reasons why the method of managing the operation of the rolling mill is inefficient. First, the operator may not have previously rolled the same material, or, if he has, he may not have worked with the same starting and finishing gauges. Alternatively, he may not have experience with the particular material being rolled on the rolling mill in question. In such cases, he cannot rely upon his experience and is relegated to trial and error estimates on every pass. It is then almost impossible to roll efficiently. When the operator is not very experienced, the problem is accentuated further.

Moreover, if the rolling mill is operated on a shift basis, as is normal, then each mill operator will set up the mill differently, according to his own previous experience. As a consequence, there are normally large variations in rate of production and product quality achieved from shift to shift.

Further, if a plant has several different rolling mills, and there is a need to transfer an operator from one mill to another, the operator's previous experience is of limited value. If the second mill (including its drive) is not identical in all respects to the first, the permissible pass reductions may be greater or less than those for the first mill.

Even when a skilled operator has machine specific experience, it is common for inefficiencies to arise. When the strip thickness is approaching the finished gauge, for example, an operator frequently has great difficulty in determining intermediate gauges. He might, for example, have to decide at a certain point whether to make another 2 or another 3 passes. Even if he chooses the most efficient number of passes, he then has to guess at the appropriate intermediate gauge(s).

One prior art method of rolling mill management, which, to some extent overcomes some of the problems outlined above, is the so-called "programmed pass schedule" method. With this method a rolling schedule for a given material, width, starting and finishing gauges, (and a given rolling mill) is stored in a computer memory. When it is desired to repeat that schedule with a fresh coil, the mill settings for each pass are recalled from the memory and the operator sets the mill (or the mill is set automatically) to these settings.

This programmed pass schedule method may be satisfactory when the range of materials, starting and finish gauges, and widths is very small. However, if the range is large, the amount of memory needed, and the amount of labor needed to determine all possible schedules and store them in the memory become prohibitive.

Even when the range of materials, gauges, etc. is small, the following problems still remain:

(1) Any particular schedule stored may not utilize the mill load capacity and mill drive capacity fully.

(2) The schedule will, in general, be only good for the one mill.

(3) The schedule does not allow for variations in work roll size (as these rolls wear), nor does it allow for the fact that mills can frequently operate at higher power levels (and thus be more productive) in winter than in summer.

(4) The schedule cannot allow for operator intervention. Since the operator may have to change an intermediate gauge for a number of reasons, he would then be obliged to reschedule all remaining passes, since the programmed pass schedule will no longer apply.

(5) There will still be some coils to be rolled having combinations of material type, width and gauges which will not be stored in the memory. For any such coils, the operator must determine mill settings by trial and error.

BRIEF SUMMARY OF THE INVENTION

In accordance with the invention, a method is provided for optimizing the operation of a rolling mill of the type having a mill structure, a pair of work rolls rotatably supported in the mill structure for reducing the dimensions of the workpiece being rolled, means for varying the separation force between the work rolls, drive means for rotating the work rolls, and control means for controlling the operation of the rolling mill. The method includes the steps of storing information representative of the parameters of the rolling mill and the workpiece in the control means. The stored values are then used to calculate a pass reduction schedule to reduce the workpiece to the desired dimensions by multiple passes through the work rolls. An iterative calculation is then performed to determine the maximum workpiece dimension the mill can achieve, as limited by the separating force capacity of the mill structure, the drive torque capacity of the drive means, the skidding of the rolls related to the workpiece material, the maximum permissible pass reduction, the entry and exit tensions, if any, on the workpiece, and the desired workpiece dimension. The calculated pass information is then used to operate the control means to optimize operation of the rolling mill by controlling the separating force between the working rolls and the speed of the drive means.

In accordance with one particularly advantageous aspect of the invention, the calculated pass schedule is adjusted for selective of the last several passes to equalize the separating force on those selected passes for optimizing the flatness of the rolled workpiece.

In a still further aspect of the invention, the actual gauge of the workpiece after rolling a pass is compared to the calculated gauge for that particular pass. If the measured workpiece gauge deviates from the calculated gauge, a new pass schedule for all subsequent passes is recalculated.

In yet another aspect of the invention, the calculated pass reduction values are transferred from the control means to the rolling mill for automatic control of the mill.

In still another aspect of the invention, the control means provides a prompt to the operator after each non-final pass to enable the operator to indicate whether a particular exit gauge was achieved on the previous pass. If the calculated exit gauge and the measured exit gauge for a particular pass differ by a predetermined amount, the pass reduction schedule is recalculated.

In still another aspect of the invention, the control means operates the rolling mill automatically, while still enabling manual settings on the mill to remain in use during automatic operation.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENTS

Figure 1:
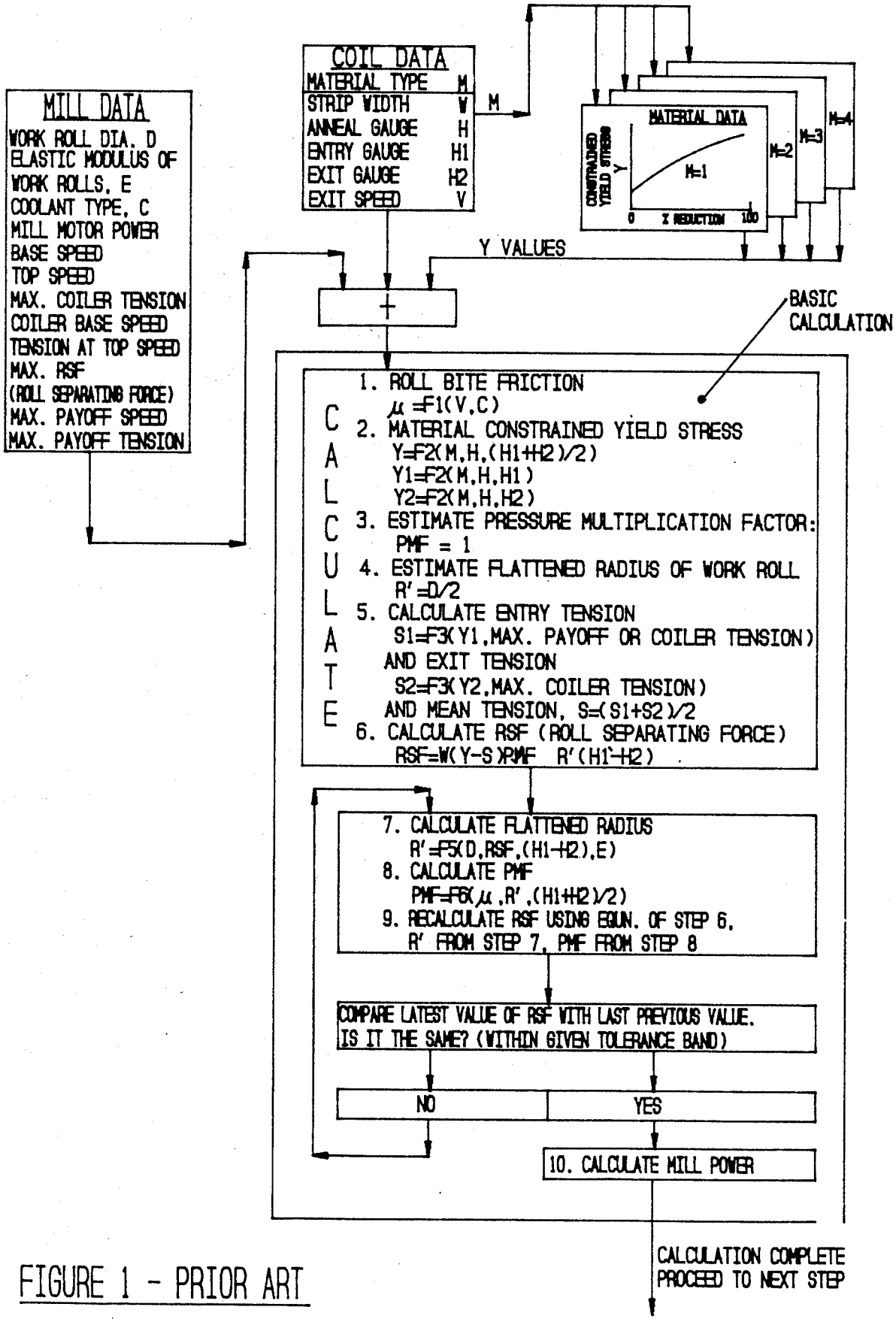
FIG. 1 is a schematic diagram showing how the roll separating force and power are calculated for a pass.

FIG. 1 shows in diagrammatic form the basic calculation method adopted by most theories of cold rolling. Such well-known theories as that of Bland and Ford, and that of Stone, all adopt such methods.

It is generally understood by those skilled in the art that the roll separating force can be calculated using an equation of the general form given in step 5 of FIG. 1, regardless of which particular theory is adopted.

The differences between the several theories usually lie in the assumptions made, and the methods of calculating the effect of the flattening of the work rolls, and the methods of calculating the pressure multiplication factor (PMF).

Roll flattening occurs due to the very high pressures that occur in the cold rolling of metals. It can be particularly severe if strip thickness is small relative to the work roll diameter, and if the material being rolled is very hard.

Because the circumferential speed of the rolls is uniform as it passes through the roll bite, but the speed of the strip increases as it reduces in thickness through the bite, the strip is normally slipping backwards relative to the rolls at the entry side of the roll bite, and slipping forwards relative to the rolls at the exit side of the bite. At one point in the bite, the neutral point, the strip will be traveling at the same speed as the rolls. These phenomena of backward slip, forward slip and neutral point are well known in the art, and are described in any textbook on rolling.

In order to overcome the effect of friction between rolls and strip, which tends to resist the forward and backward slip, and hence to resist the elongation of the strip, additional roll separating force (RSF) is required. The factor of increase of RSF due to friction is known as the pressure multiplication factor (PMF).

A common feature of most rolling theories is the necessity to guess or estimate the roll flattening and PMF values at the start of the calculation, then to use an iterative procedure to calculate RSF, the iterative procedure being completed when the RSF calculated from the assumed values of roll flattening and PMF (step 9) when used in steps 7 and 8, gives the same values of roll flattening and PMF that were assumed.

In order to proceed with the basic calculations, the mill data, coil data and material data as listed in FIG. 1 must be known. The calculation proceeds by calculating roll bite friction coeffecient (step 1) for which rolling speed and coolant type must be known, and constrained yield stress of material at start (Y1) middle (Y) and end (Y2) of pass (step 2) for which material of strip, gauge at which strip was last annealed, entry and exit gauges must be known. The third and fourth steps estimate the pressure multiplication factor, and the flattened radius of the work roll. The fifth step calculates entry and exit tension, the entry tension being the actual payoff or uncoiler tension, or the maximum tension as limited by the strength of the material (it is usually limited to one-third of Y1) whichever is less, and the exit tension being limited by the coiler tension, or the maximum tension as limited by the strength of the material (usually limited to Y2/3) whichever is less.

The roll separating force (RSF) is next calculated (step 6) then the flattened radius (R′) (step 7) and the pressure multiplication factor (PMF) (step 8) are calculated using the RSF value from step 6. Finally, the RSF is recalculated (step 9) using the values of R′ and PMF from steps 7 and 8. Steps 7, 8 and 9 are repeated until the convergence is obtained, that is, until the value of RSF obtained from step 9, when inserted in step 7, results in the same values of R′ and PMF used to calculate the RSF value.

This basic calculation is incorporated at the heart of my mill management system. It is to be understood that the precise theory used and whether it is iterative or noniterative is not important, provided that it is a well tried theory that has been shown to give reasonably close agreement with practice.

Figure 2:
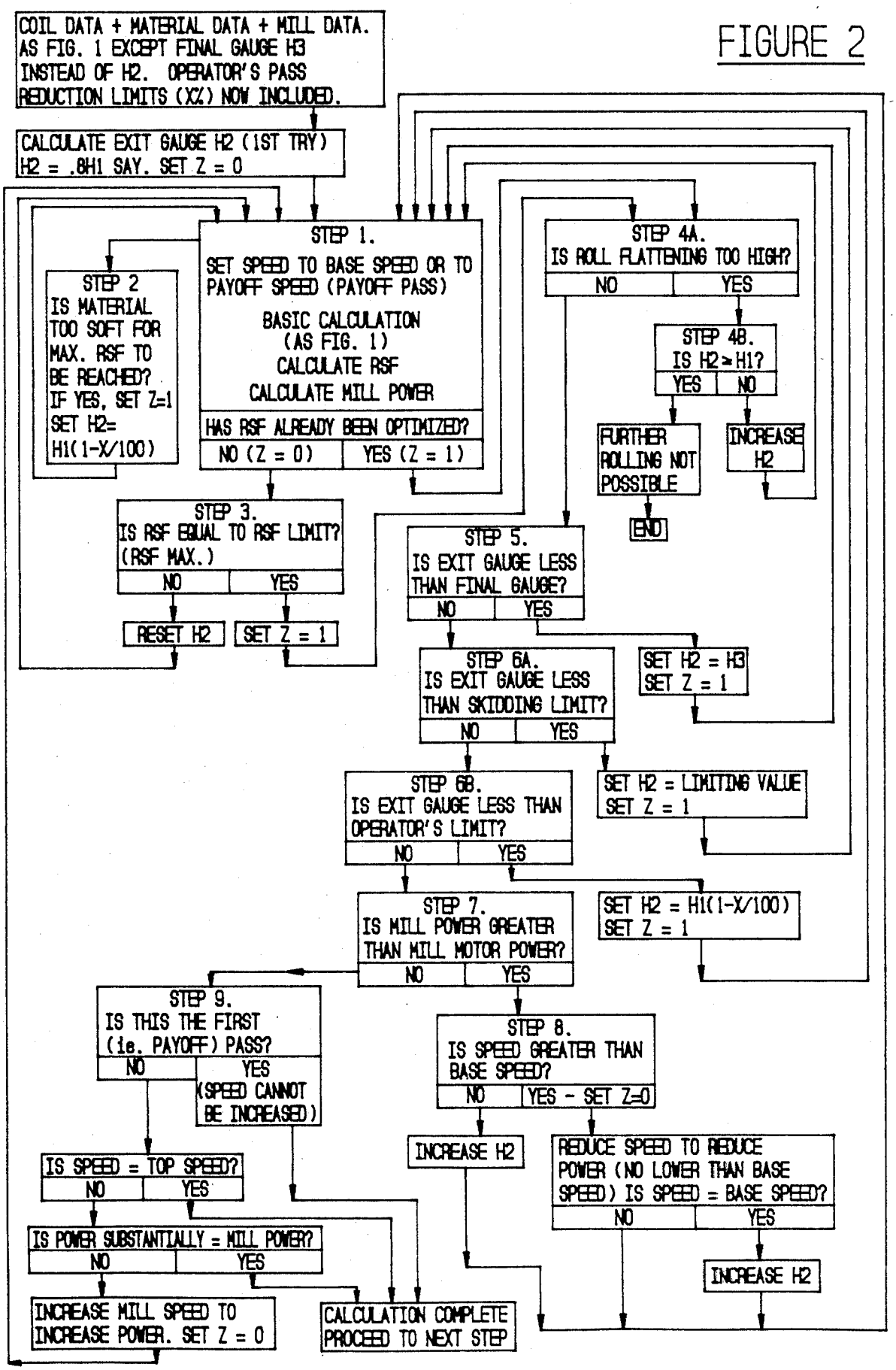
FIG. 2 is a logic diagram showing how the system maximizes the reduction to achieve maximum power and/or roll separating force for a pass.

FIG. 2 is a logic diagram showing how the pass reduction is maximized for any pass. Limiting factors are:

(1) Available mill torque (i.e., power at base speed of mill drive);

(2) Allowable roll separating force (mechanical limit of mill structure);

(3) Skidding limit (if too high a reduction is attempted for a given work roll size, the rolls will skid on the strip, and rolling is impossible);

(4) The percentage reduction must not exceed the maximum permissible pass reduction set by the operator (experience or special requirements limit). It is known by experience that pass reductions must be limited with some strip materials, and on some mills which do not have very high tensions, in order to produce a flat strip. At light gauges, such limits are often achieved before the power limit or RSF limits are reached. For example. on Sendzimir mills rolling light gauge stainless steels, pass reductions of over 60% can be achieved typically. However, in practice, pass reductions greater than 20–25% are rarely taken because of flatness difficulties. Also, special requirements sometimes dictate pass reductions. This is discussed later.

(5) Final gauge—the pass reduction cannot be so high that the exit gauge is less than the final (target) gauge.

The first step (step 1) is to perform the basic calculation for a nominal pass reduction (say 20%) using the prior art method of FIG. 1.

The next step (step 2) is to check if the material is hard enough for the maximum RSF to be developed. (For example, if a material such as lead is rolled in a Sendzimir mill, having very small work rolls, the rolls will cut through the strip before maximum RSF is developed).

The third step is to compare the RSF with the maximum RSF of the mill, and, if it is not equal to RSF max., then to increase or decrease the exit gauge accordingly, and repeat the basic calculation. This procedure (iteration) is repeated until the RSF reaches the maximum value.

The fourth step is to check that the roll flattening factor is not too high. If it is too high, then the exit gauge is increased a small step at a time, and basic calculation repeated until roll flattening factor becomes acceptable.

The fifth step is to check that the exit gauge is no less than the final desired gauge. If it is, then the exit gauge is made equal to the final gauge, and the basic calculation made once more.

The sixth step is to check that the exit gauge is not less than the allowable gauge, as dictated by the skidding limit and experience limit. If it is less than the experience limit or the skidding limit, then the exit gauge is set to the skidding limit or the experience limit (whichever is greater) and the basic calculation repeated.

The seventh step is to compare the mill power with the available power from the mill motor at the rolling speed. (Mill power up to the base speed is proportional to speed. Above the base speed mill power is constant.) If the mill power is greater than the available power, then step eight will be made. If not, then step nine will be made.

The eighth step (mill power too high) is to compare the mill speed with the base speed. If the speed is less than or equal to the base speed, then the exit gauge is increased (to give draft H1-H2 reduced in proportion to desirable reduction in mill power) and basic calculation is repeated. If the speed is greater than the base speed, then the speed is reduced, and the exit gauge may be increased, and the basic calculation is repeated.

The ninth step (power OK or too low) is to compare the mill speed with the base speed. If the speed is less than the base speed, it means that the speed is limited by the speed of the payoff line, and cannot be increased. In this case, the calculation is complete. If the speed is greater than or equal to the base speed, then the speed is increased in proportion to the desired increase in mill power, or to the top speed (whichever is lower) and the basic calculation is repeated. If the speed is equal to the top speed, it cannot be increased and the calculation is complete.

Note that each time the basic calculation is repeated the computation returns to step 1 and repeats all the successive steps and must satisfy the conditions of each step again before proceeding, with one exception. The exception is that, if the speed has not been changed after the last RSF maximization (step 3) then step 3 is omitted. The reason for this is that the pass reduction for maximum RSF does not change (unless the speed is changed) and, therefore, since all steps after step 3 only reduce the pass reduction (i.e., increase H2), then the condition of step 3 is automatically satisfied provided that the speed is not changed.

Eventually all the conditions will be satisfied and the final gauge and rolling speed achieved will ensure that at least one of the above limits (2)–(5) will be reached for the pass, and that either limit (1) will be reached, or the mill will be rolling at the top speed (except for the first pass—known as the payoff pass—where speed is restricted by the speed of the payoff line. However, even in this case the full available mill power at the payoff line speed will be developed).

Figure 3:
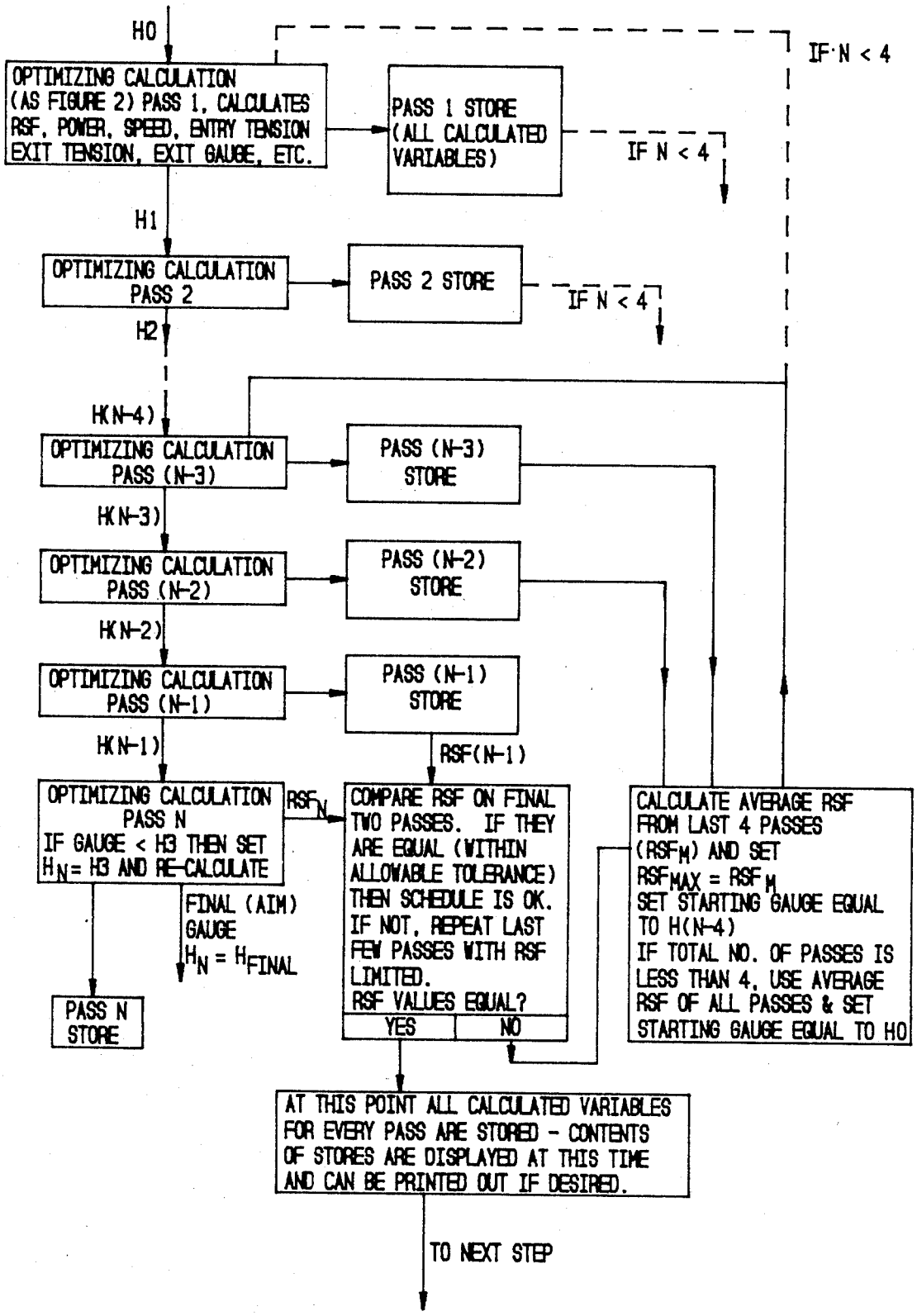
FIG. 3 is a logic diagram showing how the system maximizes reductions on a multi-pass schedule, and also equalizes the roll separating force on the last several passes.

FIG. 3 is an example showing how a multi-pass rolling schedule is developed using the optimizing calculation of FIG. 2. For each pass the calculation of FIG. 2 is used to establish the minimum gauge that can be achieved. This gauge is taken as the starting gauge for the next pass. Then the procedure is repeated for succeeding passes until the final gauge is achieved. After each pass calculation the results of the calculation are stored.

Usually for the last few passes the RSF values will be fairly close to each other except for the final pass which could have a value of RSF anywhere between slightly more than zero and the maximum value (depending how close the exit gauge on the penultimate pass is to the final gauge). Since it is desirable to have reasonably closely matched RSF values on the last several passes (enabling the same mill profile settings to be used without producing drastic changes in strip profile from pass to pass) as is well known in the art, then the system compares the RSF values on the final two passes, and, if they are not equal (within, say, a 10% tolerance band), then the last few passes are repeated, with the RSF limit set to the average value for these passes. This procedure is repeated until the RSF values on the last few passes are equal (within the allowable tolerance band).

In the example of FIG. 3, the system repeats all the passes, or the last four passes, whichever is fewer, with the RSF limit set accordingly. The result of this procedure is that the RSF values for all the passes, or for the last four passes, are equalized, thus giving the best rolling conditions for strip flatness, while the total number of passes is exactly the same as before, so the total time to complete rolling of the coil will be the same as it was for the schedule before the RSF equalizing procedures was followed. In fact, calculations show that the time will be a little shorter, since the exit gauge on all the equalized passes (except the last) will be a little higher than before RSF equalizing, hence the total length of the strip shorter. Furthermore, as the pass reduction on all the equalized passes (except the last) is small than before RSF equalizing, the rolling speed is usually higher, (at the same mill power level) and this shortens the pass time even more.

Table 1 shows a typical display on the monitor of our system after pass reduction optimization, but before RSF equalization. Table 1 shows a 7 pass schedule for rolling stainless steel 50 inches wide from 0.15 inch down to 0.035 inch. The mill motor power is 2500 HP and base speed 500 FPM, and it can be seen that the power limit is reached on passes 2–5. Also, the rolling load (RSF) limit is reached on pass 6. On pass 6 the system increases the mill speed to 558 FPM in order to use up all the available mill power. Since the gauge after 6 passes (0.037 in.) is so close to the desired final gauge, the final pass reduction is only 5.5%, giving a RSF of only 51%.

Table 2 shows how the system updates the monitor display after performing the RSF equalization procedure. It can be seen that the last four passes are repeated and RSF values of about 85% are developed on the last four passes. The rolling speed is increased on all these passes above 500 FPM to utilize the available mill power. Ir can be seen that the total pass time for the last four passes is less after RSF equalization (18.8 minutes) than it was before (21.8 minutes).

Figure 4:
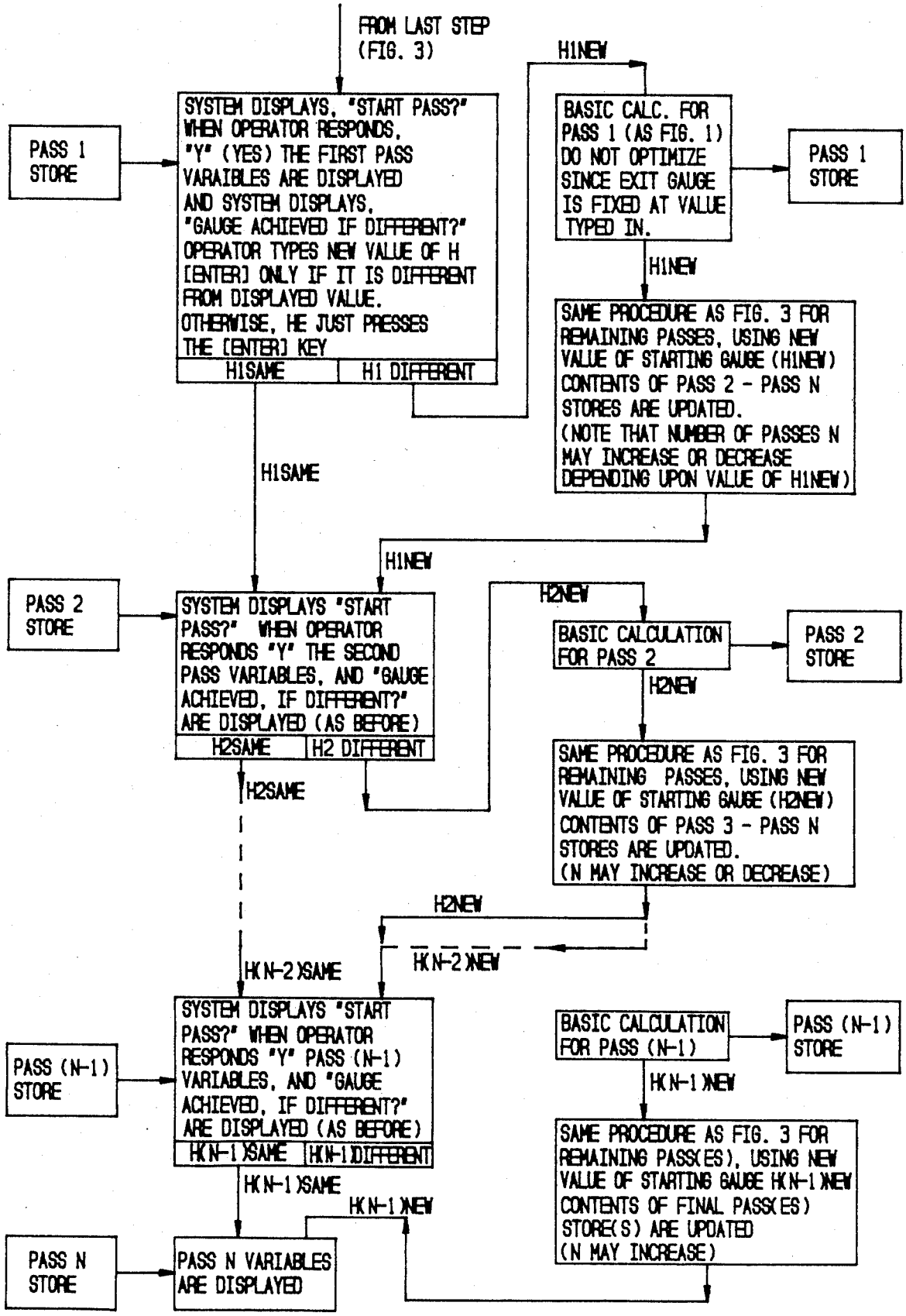
FIG. 4 is a logic diagram showing how the system can accept operator intervention at any stage and reoptimize the remaining passes.

FIG. 4 shows how my mill management system can accommodate deviations from the planned roll pass schedule and still provide the operator with optimized pass reductions from the point of deviation onward. This feature is of great value, since the mill operator may have to adjust the pass reduction on a given pass for a variety of reasons. Possible reasons are (a) the strip flatness at the optimized reduction is unsatisfactory—this could be caused by unusual profile of incoming strip, incorrect mill settings or incorrect roll crowns; (b) the strip is harder (or softer) than was assumed by the computer, due to variations in the proportions of the elements in the alloy being rolled or perhaps to the rolled material being improperly annealed before delivery to the mill; (c) roll skidding occurring due to the mill rolls being smoother than usual, or because of a change in the mill coolant, and so on.

As shown in FIG. 4 and in Table 2, when the complete optimized and equalized schedule has been presented by our system to the operator, the system asks the operator (using the computer monitor) "START PASS?". When the operator is ready, he responds (Y [ENTER]" (i.e., the operator presses the "Y" key, then the "ENTER" key) and the system then displays the values of variables for the first pass (i.e., exit gauge, speed, entry tension, and exit tension) so that the operator can set the mill to these values. The system also displays "Gauge achieved, if different?" as shown in Table 3.

When the operator has completed the pass, if the gauge achieved by the rolling mill was equal to the exit gauge specified by the system for that pass, then the operator simply presses the "ENTER" key on the computer keyboard, and the system displays the variables for the next pass, and "Gauge achieved, if different?". As long as the operator achieves the specified exit gauge on any pass, he presses the "ENTER" key after completing the pass, and the variables for the next pass are displayed. This process continues until the final guage is achieved, i.e., rolling of the coil is completed.

If the operator does not achieve the specified gauge on a given pass, he types in the gauge achieved in response to the "Gauge achieved, if different?" prompt. For example, as shown in Table 3, if gauge achieved was 0.118 in., he would type "0.118 [ENTER]". The system then performs the basic calculation for the pass just completed (i.e., the calculation given by FIG. 1) and then peforms the optimization procedure for the remaining passes and equalizes the last few passes (i.e., the procedure given by FIG. 3 is performed for the remaining passes). The system then displays the values of the variables for the first of the remaining passes, as shown in Table 4, enabling the operator to set the mill to these values.

Thus, if the operator rolls to a different exit gauge from that specified by the system, then, provided he tells the system (via the keyboard) what gauge the mill actually achieved, the system will reoptimize and reequalize the remaining passes based upon the actual gauge achieved. It can be seen that the system is highly adaptive to the needs of the mill operator in this respect. This reoptimizing and reequalizing procedure can be performed on every pass, if necessary, (except the last pass).

It is envisaged that the system can also be interfaced to a reversing rolling mill and its drive system, in order to provide the optimum mill settings automatically, without operator intervention being required to set the correct values of the mill variables manually.

Figure 5:
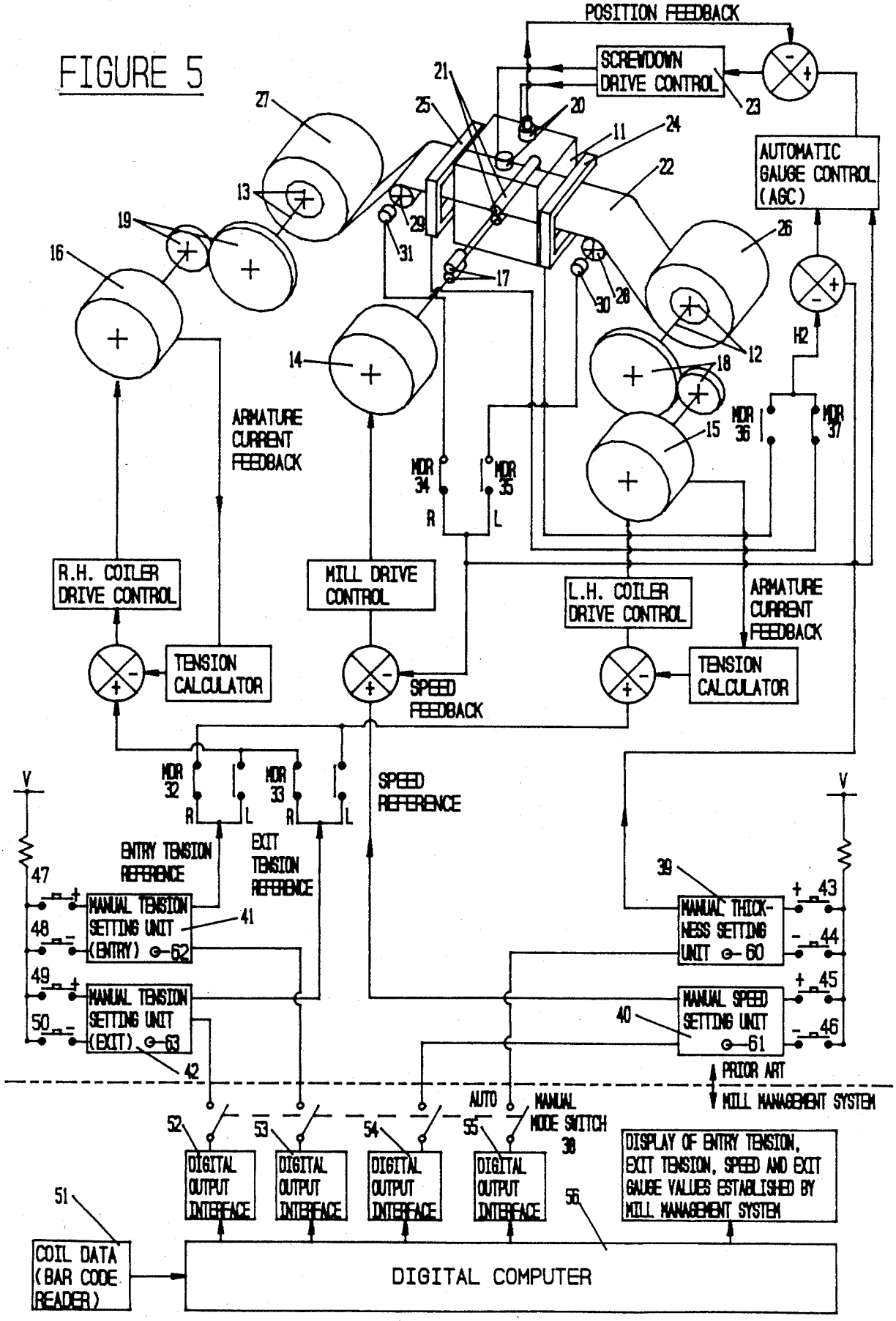
FIG. 5 is a schematic diagram showing how the system is integrated with a typical prior art mill and its control systems to provide the management function.

In FIG. 5, I show one example of how the system can be interfaced to a typical prior art rolling mill and its drives and its four main control systems (speed control, entry tension control, exit tension control and gauge control). The rolling mill 11 with view taken from the rear shown in FIG. 5 is a reversing mill, and is provided with tension reels (coilers) 12 and 13 on left and right sides of the mill. The mill and the tension reels are each driven by direct current electric motors 14, 15 and 16 through gear sets 17, 18 and 19. The mill incorporates a screwdown 20 to adjust the gap between the work rolls 21 (and hence the thickness of the material 22 rolled by the mill) the screwdown itself incorporating a drive and position control system 23. Thickness gauges 24 and 25 are provided on left and right sides of the mill to measure the thickness or gauge of the strip entering and leaving the mill stand on every pass. The strip is wound into coils 26 and 27 on the tension reels 12 and 13.

Deflector rolls 28 and 29 are mounted on left and right sides of the mill to provide a constant pass line for the strip 22 passing between the mill rolls 21. The strip wraps around these rolls as it travels between each tension reel and the mill rolls. A speed sensing transducer 30 or 31 (tachogenerator or rotary optical incremental encoder) is coupled to each deflector roll. These transducers measure the speed of the deflector rolls (and hence the strip) on left and right sides of the mill.

This prior art mill and its drive are controlled as follows: The speed of the mill and coilers is determined by the speed of the mill motor which is controlled by a simple speed control loop, with stable operating conditions being achieved when the feedback signal from the exit side strip speed sensing transducer is equal to the speed command or reference signal.

Each tension reel motor is controlled to provide constant tension in the strip between reel and the mill stand. In the example shown, tension is effectively sensed by measuring armature current in the reel motor, and this current is suitable scaled to an equivalent tension value and compared with a tension reference signal. Stable operation is achieved when the scaled armature current value is equal to the tension reference signal.

The automatic gauge control system operates by comparing the strip exit gauge (measured by a continuous thickness gauge) with the exit gauge reference signal, and sending a commend signal to the mill screwdown drive according to any error (i.e., difference between exit gauge command and feedback signals) to increase or decrease the roll gap accordingly. As is well known in the art, the gauge control system must allow for the transport lag between the mill rolls and the exit side thickness gauge, and, so is provided with speed signals from the speed transducers to evaluate this lag.

To enable the reversing operation to be controlled, the operator has a switch (not shown) to select mill direction (left to right (R); and right to left (L)). This switch is coupled to an electrical relay known as the mill direction relay (MDR). The MDR is provided with contacts (not shown) to reverse the rotation of the mill motor, and with contacts 32, 33 which provide for correct routing of entry and exit tension command signals, contacts 34, 35 which provide for correct tachometer signal for exit side strip speed sensing, and contacts 36, 37 which provide correct exit side thickness feedback signal, according to the mill direction.

In FIG. 5, I show how, using a mode switch, the reference signals for the four main mill control systems can either be set up manually by the mill operator, according to the displayed optimized values given by the mill management system, or they can be set up directly by the mill management system. In the former case, the mode switch is set to manual, and in the latter case it is set to automatic.

FIG. 5 also shows how, even if the mode switch is set to automatic, the operator still retains his power to intervene. When the automatic mode is selected, the computer presets all the manual references (command signals) to the optimized values at the beginning of every pass, by presetting units to the computer optimized reference values. After rolling commences, the operator can increase or decrease settings exactly as he would in manual mode because the setting units remain in use in automatic, as well as in manual mode.

When the mode switch 38 is set to either mode, the operator can adjust settings of strip thickness using push buttons 43 and 44 to increase or decrease the value of the reference signal generated by setting unit 39. Similarly, he can adjust rolling speed using push buttons 45 and 46 which control speed setting unit 40, entry tension using push buttons 47 and 48 which control entry tension setting unit 41, and exit tension using push buttons 49 and 50.

The design of the setting units is prior art. Typically, they could consist of a voltage to frequency converter, (to convert the operator input signals to a digital rate signal) and a bidirectional counter (to cound the pulses from the converter, counting up if the increase push button is pressed, and counting down if the decrease push button is pressed). The output of the counter will represent the reference value of the controlled variable. For example, on the thickness setting unit, a count of 1754 could represent 0.1754 inches. The bidirectional counters can be preset to any value using the preset inupts, upon the operator depressing "preset enable" push buttons 60–63. For simplicity I have shown "preset enable" push buttons 60–63 on setting units 39–42. In practice, this function would be achieved more conveniently by a single "preset enable" push button with relay connection to the four units, or by relay connection from the mill direction relay (MDR) to actuate the "preset enable" function on the four setting units whenever the operator changes the mill direction.

Such setting units would also be suitable for use on such prior art mill management systems as the "programmed pass schedule" method described abover, where the preprogrammed values of gauges, tensions and speeds could be preset using the preset units.

In the case of our invention, the digital computer 50 is provided with digital output interfaces 52–55. These are commercially available interfaces which can be operated under the control of the computer, and which contain a memory in which the reference value calculated by the computer is stored while the computer proceeds with other tasks. Before the start of every pass, the computer takes the values of exit tension, entry tension, speed and exit gauge from the store for the pass (see FIG. 3 and FIG. 4) and transfers these values to the interfaces 52, 53, 54 and 55, respectively. These values remain stored in the respective interfaces until just before the start of the next pass when the computer takes the values of the same variables from the store for the next pass and transfers these values to the interfaces.

The exact time that the transfer of new values of the variables from the pass store (internal to digital computer 50) to the output interfaces is when the operator types "Y" in response to the system prompt "START PASS?" (see FIG. 4) when the remaining passes have been reoptimized, or when the operator presses the [ENTER] key in response to the system prompt "GAUGE ACHIEVED, IF DIFFERENT?" (in this case, the mill has achieved the exit gauge specified by the computer, and reoptimization is not required). At the same time that these new values of the variable are transferred, the same values are displayed on the monitor.

The example of my method shown in FIG. 3, which achieves substantially equal roll separating force on the last few passes, serves the requirements of most applications, where the prime requirement is of good strip flatness, with minimum time lost by changing mill settings.

In some cases, however, the requirements may be different. For example, if high surface brightness or lustre is to be achieved, best results are obtained if freshly ground or polished work rolls are inserted into the mill just before the final pass, and if the pass reduction taken on the final pass is very light. In such cases it is a simple matter to change the mill profile settings (and even the work roll crowns) while the work rolls are being changed before the last pass, with no additional lost time.

Also, sometimes the metallurgy of the strip requires a predetermined reduction on the first pass, or on the last pass.

In these cases, my method is still valid but is modified in that the method of FIG. 3 is applied only to those passes whose reductions are not predetermined. For example, rolling from 0.35 in. to 0.1 in. thickness, with 10% reduction specified for the final pass, the management system will follow the procedure of FIG. 3 for a starting gauge (Ho) of 0.35 in. and a finish gauge (Hn) of 0.111 in. It will then follow the calculation procedure of FIG. 2 using 10% as the operator's pass reduction limit to determine the values of variables for the predetermined final pass rolling from 0.111 to 0.1 in. In this way, the program also checks that the 10% reduction is within the capability of the mill and its drives.

As another example, when rolling from 0.2 in. thickness to 0.05 in., with 15% reduction specified for the first pass, the management system will follow the procedure of FIG. 3 for all passes, with 15% reduction set as the operator's limit for the first pass. This procedure again checks that the predetermined 15% reduction is feasible.

The value of the operator's pass reduction limit control can be seen from the above. The operator can impose separate limits for the first pass, the intermediate passes, and for the final pass, so that the above special cases can be handled with ease.

TABLE 1

| # | VARIABLE | OLD VALUE | NEW VALUE |
|---|---|---|---|
| 1 | WORK ROLL DIAMETER (IN) = | 5.000 | |
| 2 | MATERIAL NUMBER = | 13 | 304 STAINLESS STEEL |
| 3 | TENSION STRESS (LB/IN ^ 2) = | 50000.000 | |
| 4 | ANNEAL GAUGE (IN) = | 0.150 | |
| 5 | STRIP WIDTH (IN) = | 50.000 | |
| 6 | COIL WEIGHT (LB) = | 20000.000 | |
| 7 | STARTING GAUGE (IN) = | 0.150 | |
| 8 | FINAL GAUGE (IN) = | 0.035 | |

| PASS NO. | EXIT GAUGE IN | % RED. % | TOTAL RED. % | PASS SPEED FPM | ENTRY TENS. LB | ENTRY TENS. AMP | EXIT TENS. LB | EXIT TENS. AMP | MILL PWR. HP | MILL PWR. AMP | ROLLG LOAD % | PASS TIME MIN |
|---|---|---|---|---|---|---|---|---|---|---|---|---|
| 1 | 0.1155 | 23.0 | 23.0 | 300 | 5000 | 152 | 50000 | 1522 | 1527 | 1899 | 70.2 | 4.4 |
| 2 | 0.0942 | 18.5 | 37.2 | 500 | 37500 | 1142 | 50000 | 1523 | 2542 | 3160 | 78.2 | 3.5 |
| 3 | 0.0773 | 18.0 | 48.5 | 500 | 50000 | 1522 | 50000 | 1522 | 2549 | 3169 | 84.3 | 4.0 |
| 4 | 0.0622 | 19.5 | 58.5 | 500 | 50000 | 1523 | 50000 | 1522 | 2528 | 3144 | 91.0 | 4.8 |
| 5 | 0.0485 | 22.0 | 67.7 | 500 | 50000 | 1523 | 50000 | 1523 | 2530 | 3145 | 98.3 | 5.9 |
| 6 | 0.0370 | 23.6 | 75.3 | 558 | 50000 | 1522 | 50000 | 1522 | 2534 | 3151 | 99.9 | 6.7 |
| 7 | 0.0350 | 5.5 | 76.7 | 1000 | 40000 | 1218 | 40000 | 1218 | 849 | 1056 | 51.0 | 4.4 |

TABLE 2

| # | VARIABLE | OLD VALUE | NEW VALUE |
|---|---|---|---|
| 1 | WORK ROLL DIAMETER (IN) = | 5.000 | |
| 2 | MATERIAL NUMBER = | 13 | 304 STAINLESS STEEL |
| 3 | TENSION STRESS (LB/IN ^ 2) = | 50000.000 | |
| 4 | ANNEAL GAUGE (IN) = | 0.150 | |
| 5 | STRIP WIDTH (IN) = | 50.000 | |
| 6 | COIL WEIGHT (LB) = | 20000.000 | |
| 7 | STARTING GAUGE (IN) = | 0.150 | |
| 8 | FINAL GAUGE (IN) = | 0.035 | |

| PASS NO. | EXIT GAUGE IN | % RED. % | TOTAL RED. % | PASS SPEED FPM | ENTRY TENS. LB | ENTRY TENS. AMP | EXIT TENS. LB | EXIT TENS. AMP | MILL PWR. HP | MILL PWR. AMP | ROLLG LOAD % | PASS TIME MIN |
|---|---|---|---|---|---|---|---|---|---|---|---|---|
| 1 | 0.1155 | 23.0 | 23.0 | 300 | 5000 | 152 | 50000 | 1522 | 1527 | 1899 | 70.2 | 4.4 |
| 2 | 0.0942 | 18.5 | 37.2 | 500 | 37500 | 1142 | 50000 | 1523 | 2542 | 3160 | 78.2 | 3.5 |
| 3 | 0.0773 | 18.0 | 48.5 | 500 | 50000 | 1522 | 50000 | 1522 | 2549 | 3169 | 84.3 | 4.0 |
| 4 | 0.0638 | 17.4 | 57.5 | 564 | 50000 | 1523 | 50000 | 1523 | 2511 | 3121 | 84.9 | 4.3 |
| 5 | 0.0526 | 17.5 | 64.9 | 641 | 50000 | 1523 | 50000 | 1523 | 2537 | 3154 | 85.0 | 4.5 |
| 6 | 0.0429 | 18.4 | 71.4 | 703 | 50000 | 1523 | 50000 | 1523 | 2533 | 3149 | 85.2 | 4.9 |
| 7 | 0.0350 | 18.5 | 76.7 | 816 | 49032 | 1493 | 49032 | 1493 | 2489 | 3095 | 81.7 | 5.1 |

START PASS ?

TABLE 3

| # | VARIABLE | OLD VALUE | NEW VALUE |
|---|---|---|---|
| 1 | WORK ROLL DIAMETER (IN) = | 5.000 | |
| 2 | MATERIAL NUMBER = | 13 | 304 STAINLESS STEEL |
| 3 | TENSION STRESS (LB/IN ^ 2) = | 50000.000 | |
| 4 | ANNEAL GAUGE (IN) = | 0.150 | |
| 5 | STRIP WIDTH (IN) = | 50.000 | |
| 6 | COIL WEIGHT (LB) = | 20000.000 | |
| 7 | STARTING GAUGE (IN) = | 0.150 | |
| 8 | FINAL GAUGE (IN) = | 0.035 | |

| PASS NO. | EXIT GAUGE IN | % RED. % | TOTAL RED. % | PASS SPEED FPM | ENTRY TENS. LB | ENTRY TENS. AMP | EXIT TENS. LB | EXIT TENS. AMP | MILL PWR. HP | MILL PWR. AMP | ROLLG LOAD % | PASS TIME MIN |
|---|---|---|---|---|---|---|---|---|---|---|---|---|
| 1 | 0.1155 | 23.0 | 23.0 | 300 | 5000 | 152 | 50000 | 1522 | 1527 | 1899 | 70.2 | 4.4 |

GAUGE ACHIEVED (IN), IF DIFFERENT ? .118

TABLE 4

| # | VARIABLE | OLD VALUE | NEW VALUE |
|---|---|---|---|
| 1 | WORK ROLL DIAMETER (IN) = | 5.000 | |
| 2 | MATERIAL NUMBER = | 13 | 304 STAINLESS STEEL |
| 3 | TENSION STRESS (LB/IN ^ 2) = | 50000.000 | |
| 4 | ANNEAL GAUGE (IN) = | 0.150 | |
| 5 | STRIP WIDTH (IN) = | 50.000 | |
| 6 | COIL WEIGHT (LB) = | 20000.000 | |
| 7 | STARTING GAUGE (IN) = | 0.150 | |
| 8 | FINAL GAUGE (IN) = | 0.035 | |

| PASS | EXIT GAUGE | % RED. | TOTAL RED. | PASS SPEED | ENTRY TENS. | ENTRY TENS. | EXIT TENS. | EXIT TENS. | MILL PWR. | MILL PWR. | ROLLG LOAD | PASS TIME |
|---|---|---|---|---|---|---|---|---|---|---|---|---|

TABLE 4-continued

| NO. | IN | % | % | FPM | LB | AMP | LB | AMP | HP | AMP | % | MIN |
|---|---|---|---|---|---|---|---|---|---|---|---|---|
| 1 | 0.1180 | 21.3 | 21.3 | 300 | 5000 | 152 | 50000 | 1523 | 1346 | 1674 | 66.1 | 4.3 |
| 2 | 0.0962 | 18.5 | 35.9 | 500 | 37500 | 1142 | 50000 | 1523 | 2541 | 3159 | 77.1 | 3.4 |
| 3 | 0.0792 | 17.7 | 47.2 | 500 | 50000 | 1523 | 50000 | 1523 | 2525 | 3139 | 83.2 | 4.0 |
| 4 | 0.0649 | 18.0 | 56.7 | 532 | 50000 | 1522 | 50000 | 1522 | 2498 | 3106 | 86.6 | 4.4 |
| 5 | 0.0533 | 18.0 | 64.5 | 617 | 50000 | 1523 | 50000 | 1522 | 2541 | 3160 | 86.5 | 4.6 |
| 6 | 0.0432 | 18.9 | 71.2 | 674 | 50000 | 1522 | 50000 | 1523 | 2527 | 3141 | 86.8 | 5.0 |
| 7 | 0.0350 | 19.0 | 76.7 | 785 | 50000 | 1523 | 50000 | 1523 | 2484 | 3088 | 83.2 | 5.3 |
| START PASS ? | | | | | | | | | | | | |

What is claimed is:

1. A method of optimizing the operation of a rolling mill having a mill structure, a pair of work rolls rotatably supported in the mill structure for reducing the dimensions of a workpiece being rolled, means for varying the separation force between the work rolls, drive means for rotating the work rolls, and control means for controlling the operation of the rolling mill, said method comprising the steps of:

(a) storing, in the control means, values representative of the separation force capacity of the mill structure for the work rolls, and values representative of the drive torque capacity of the drive means;

(b) storing, in the control means, values representative of properties of the material from which the workpiece to be rolled is to be formed;

(c) storing, in the control means, values representative of the dimensions of the workpiece to be rolled and the desired dimensions to be produced by the rolling mill;

(d) storing, in the control means, values representative of the maximum permissible pass reduction for first pass, intermediate passes and final pass of the workpiece through the work rolls;

(e) using the values stored in the control means to calculate a pass reduction schedule to reduce the workpiece to the desired dimensions by multiple passes through the work rolls, and for each pass making an iterative calculation to determine the minimum workpiece dimension the mill can achieve as limited by the separating force capacity of the mill structure, the drive torque capacity of the drive means, the skidding of the rolls relative to the workpiece material, the maximum permissible pass reduction, and the desired workpiece dimension; and (f) using the calculated pass schedule to operate the control means to optimize operation of the rolling mill by controlling the separating force between the working rolls and the speed of the drive means.

2. A method as recited in claim 1 wherein the calculated pass schedule is adjusted for selective ones of the last several passes to equalize the separating force on those selective passes for optimizing the flatness of the rolled workpiece.

3. A method as recited in claim 1 wherein the calculated pass schedule includes a particular calculated reduction for the workpiece for each pass, and further including the step of measuring the reduction for each pass and recalculating the pass schedule for each subsequent pass if the particular calculated reduction for a pass is not achieved.

4. A method as recited in claim 1 wherein the rolling mill includes a coiler on each side of the working rolls and coiler drives for rotating the coilers, and further including the steps of storing in the control means values representative of the maximum capacity of the coiler drives, and calculating for every pass the maximum entry and exit tensions that can be applied to the workpiece as determined by the capacity of the coiler drives and the strength of the workpiece, said iterative calculation including said maximum entry and exit tensions.

5. A method of optimizing the operation of a rolling mill where the roll separating force levels on the final few passes through the work rolls are equalized to optimize the flatness of a rolled strip, including the steps of:

(a) storing in a digital computer the values of physical parameters defining the mill structure, the mill drive and the coiler drives;

(b) storing in said digital computer the values of physical parameters defining the property of materials to be rolled on the rolling mill;

(c) storing in said digital computer the values of the physical parameters defining the workpiece material to be rolled, and the desired workpiece dimensions to be produced by the operation of the rolling mill;

(d) storing in said digital computer the values of maximum permissible pass reduction for the first pass, intermediate passes, and final pass;

(e) calculating a pass schedule from the values stored in the digital computer, making an iterative calculation for each pass to determine the minimum exit gauge the mill can achieve as limited by the mill's separating force capacity, drive torque capacity, roll skidding, maximum permissible pass reduction, and final desired gauge for the workpiece, and determining the maximum rolling speed as determined by the power of the mill;

(f) calculating the maximum entry and exit tensions that can be applied to the rolled workpiece for each pass as determined by the capacity of the coiler drives and the strength of the rolled workpiece;

(g) adjusting the pass reductions on selected of the last few passes to equalize the roll separating force on those passes, and recalculating the pass schedule after such adjusting.

(h) storing in the memory of the digital computer the optimum values of exit gauge, rolling speed, entry tension and exit tension for each pass of the calculated pass schedule; and (i) displaying the optimum values of exit gauge, rolling speed, entry tension and exit tension before each pass of the pass schedule to enable the mill operator to set up the mill to achieve the calculated values.

6. A method according to claim 5 wherein the optimum values of exit gauge, rolling speed, entry tension and exit tension before each pass are transferred from the digital computer memory to the rolling mill control systems for automatic control of the mill without operator intervention.

7. A method according to claim 5 further including the steps of:

(a) providing a prompt to the operator after each non-final pass to enable the operator to indicate whether a particular exit gauge was achieved on the previous pass; and (b) in each case where the difference between the calculated exit gauge and a measured exit gauge for a particular pass exceeds a predetermined amount, repeating steps 5(e) through 5(h).

8. A method according to claim 6 wherein provision for operator intervention is made by the steps of:

(a) connecting outputs of the digital computer through suitable interface circuits to preset inputs of the rolling mill while enabling manual settings on the mill to remain in use during automatic operation;

(b) providing a prompt to the operator after each non-final pass to enable the operator to input information to the digital computer indicating whether or not the exit gauge achieved by the rolling mill on a particular pass is different from the gauge calculated for that pass in the pass schedule;

(c) whenever the exit gauge of a particular pass differs from the calculated gauge for that particular pass, repeating steps 5(e) through 5(h) for the remaining passes in the reduction pass schedule.

* * * * *